US006260721B1

(12) United States Patent
Ohmi et al.

(10) Patent No.: US 6,260,721 B1
(45) **Date of Patent: *Jul. 17, 2001**

(54) PLASTIC CAP

(75) Inventors: Hidehiko Ohmi; Tateo Kubo; Mitsuo Kumata, all of Hiratsuka (JP)

(73) Assignee: Japan Crown Cork Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/264,471

(22) Filed: Mar. 8, 1999

(30) Foreign Application Priority Data

Apr. 7, 1998 (JP) ..... 10-094970

(51) Int. Cl.[7] ..... B65D 41/48

(52) U.S. Cl. ..... 215/256; 215/317; 215/321; 215/901

(58) Field of Search ..... 215/256, 224, 215/250, 253, 254, 317, 320, 321, 344, 252, 211, 341, 343, 352, 354, 901; 220/265, 266, 270, 276, 780, 787, 792, 793

(56) References Cited

U.S. PATENT DOCUMENTS 4,071,156 * 1/1978 Lowe ..... 215/256
4,484,687 * 11/1984 Bullock, III ..... 215/256
4,593,830 * 6/1986 Bullock ..... 215/256
4,676,389 * 6/1987 Bullock ..... 215/256 X
4,875,594 * 10/1989 Ochs ..... 215/252
5,090,788 * 2/1992 Ingram et al. ..... 215/252
5,271,512 * 12/1993 Ekkert ..... 215/252
5,685,443 * 11/1997 Taber et al. ..... 215/252
5,829,612 * 11/1998 Zumbuhl ..... 215/252
5,875,908 * 3/1999 Witt et al. ..... 215/256
5,992,661 * 11/1999 Zumbuhl ..... 215/252
6,089,390 * 7/2000 Druitt et al. ..... 215/252

* cited by examiner

*Primary Examiner*—Allan N. Shoap
*Assistant Examiner*—Niki M. Eloshway
(74) *Attorney, Agent, or Firm*—Fulbright & Jaworski L.L.P.

(57) ABSTRACT

A plastic cap of this invention is opened by tearing-off and is comprising a top plate provided with a sealing portion to be engaged with the mouth of a container, a skirt extending perpendicularly from the top plate, and a tear-off portion arranged around the skirt and defining an upper closure portion for resealing and a lower opening band, wherein in the inner surface of the skirt, at an upper position than the tear-off portion, a diametrically inwardly-directed protrusion which is engaged with a jaw of the container is formed peripherally intermittently, simultaneously, at a lower position than the tear-off portion, a flap piece whose tip portion is engaged with the jaw of the bottle is formed peripherally intermittently, and the engaged protrusion and the flap piece are formed at least alternately in most of the peripheral direction. The plastic cap has excellent sealing reliability, easy openability, and tamper-evident property while the cap height is lowered and the resin weight of the resin is reduced.

3 Claims, 5 Drawing Sheets

PLASTIC CAP

BACKGROUND OF THE INVENTION

1. Field of the Invention

This invention relates to a plastic cap having a low cap height and a reduced resin weight as well as excellent sealing reliability, easy openability, and tamper-evidence.

2. Prior Art

Because resin caps can be produced by integral molding and have excellent moldability and flexibility, they can be fixed to a mouth portion of a container by a capping operation, and have been used widely in various forms.

Various resin caps having excellent openability which have excellent sealability, and can be removed easily from a mouth portion of the container without using a tool have been proposed. For example, Japanese Laid-Open Patent Publication No. 58719/1997 describes the structure of a synthetic resin cap comprising a mouth portion of a bottle, two circumferential grooves provided along its outer peripheral portion and the cap mounted in engagement with the top of the mouth portion of the bottle and the inner surface of the mouth of the bottle. This cap is a one-piece cap composed of an upper closure, a tamper-evident band and a side score portion which connects the lower end of the upper closure portion to the upper end of the tamper-evident band on a circumference.

The above prior art is significant because it provides a plastic cap openable by a hand without any particular tool such as a cap opener, and having a function of preventing a fraudulent act. However, two-staged engagement jaw portions are present for holding a tamper-evident property and for holding resealing on the outer circumference of a container, and therefore two-staged protrusion portions exist on the cap side. Because of such portions, there is an inconvenience that the cap height becomes high, and the resin weights of the mouth portion of the container and the cap become high.

SUMMARY OF THE INVENTION

It is an object of the invention to provide a plastic cap having a low cap height and a reduced weight of a resin and maintaining excellent sealing reliability, and excellent openability and tamper-evident property.

Another object of this invention is to provide a plastic cap in which by a one-stage engaging jaw portion present in the neck portion of a container, tamper-evident property and resealing property are held.

There is provided a plastic cap comprising a top plate provided with a sealing portion to be engaged with a mouth of a container, a skirt extending perpendicularly from the top plate, and a tear-off portion arranged around the skirt and defining an upper closure portion for resealing and a lower opening band, wherein in an inner surface of the skirt, at an upper position than the tear-off portion, a diametrically inwardly-directed protrusion which is engaged with a jaw of the container is formed peripherally intermittently, simultaneously, at a lower position than the tear-off portion, a flap piece whose tip portion is engaged with the jaw of the container is formed peripherally intermittently, and the protrusion and the flap piece are formed at least alternately in most of the peripheral direction.

In the cap of this invention, the following requirements should be included preferably.

1. The flap piece is provided via a continuous base portion having a small width and projecting diametrically inwardly from the inner surface of the skirt.

2. In the inner surface of the skirt above the root of the above-mentioned flap piece, a concave portion for the flap (flap-concave portion) which receives the upwardly bent flap piece is formed.
3. The flap piece is provided so that its thickness is increased from the root to tip.
4. The opening band is provided with a notched portion or a weakened portion which extends perpendicularly or obliquely and reaches the tear-off portions and a diametrically outwardly projecting opening-starting tab is provided in a portion of the opening band adjacent to the notched portion or the weakened portion.
5. The tear-off portion is composed of a groove (having a thin wall thickness) formed peripherally, or a peripheral gap formed in a lower portion of the protrusion. For example, a perpendicularly extending bridge and a groove are arranged in the lower portion of the protrusion, and the peripheral gap is formed so that at least a part of the bridge is left.

The plastic cap of this invention comprises a top plate provided with a seal portion engaged with the mouth of a container such as a bottle, a skirt extending downwardly from the top plate and a tear-off portion arranged around the skirt and defining an upper closure portion for resealing and a lower opening band. This plastic cap is characterized in that in the inner surface of the skirt, (1) at an upper position of the tear-off portion, a diametrically inwardly-directed protrusion (engaging protrusion) which is engaged with a jaw of the container is formed peripherally intermittently, (2) at a lower position than the tear-off portion, a flap piece whose tip portion is engaged with the jaw of the container is formed peripherally intermittently so that at least on most of the peripheral direction, the engaging protrusion and the flap piece are arranged alternately.

In the cap of this type, it is generally necessary that the resealing upper closure portion should be provided with an engaging portion for the container to hold resealability, and the opening band should be provided with an engaging portion for the container to hold tamper-evident property. Since in this invention a flap piece is used as the engaging portion for holding tamper-evident property, an advantage is that the mouth of the container can be easily inserted into the cap in a state in which the flap piece is upwardly bent at the time of capping, and that the engaged position by the tip of the flap piece can be established at an upper position than the opening band.

The engaging protrusion of the upper closure portion is arranged peripherally intermittently, the flap piece of the opening band is arranged intermittently, and the engaging protrusion and the flap piece are arranged alternately in most of the peripheral direction, that is to say, a bent flap piece is positioned at the vacant position free from the engaging protrusion. Hence, it is possible to engage the engaging protrusion and the tip portion of the flap piece simultaneously with a single engaging jaw of the container.

For this reason, according to this invention, one-stage engaging jaw at the neck of the container can hold tamper-evident property and resealing property. Thus, the length of the neck of the container can be shortened and the resin weight of the container can be reduced. The resin weight of the cap can be reduced, and marked advantages can be obtained in that the effective utilization of resources can be realized and the cost can be reduced.

Furthermore, the upper closure portion for resealing and the opening band are in a state of integration until cap-opening from capping. Thus, since both of the engaging protrusion and the tip portion of the flap piece are engaged with the engaging jaw, an upward or diametrically inward pressure for sealing can be increased and sealing can be performed with high reliability, and it is possible to hold tamper-evident property easily. As already pointed out, since the flap pieces are arranged intermittently, the bending of the flap pieces upwardly can be performed easily, and moreover, the capping operation is easy.

The opening of the container is carried out by tearing the opening band peripherally at the tear-off portion, removing the opening band in the stage of being integral with the flap piece, and then pushing up the upper closure for resealing. At this time, the engaging protrusion of the upper closure should climb over the engaging jaw of the container, but since in this invention, the engaging protrusion is formed peripherally intermittently, the force required to climb over the engaging jaw can be set at a lower level, the openability of this cap is excellent. Furthermore, since an engaging protrusion for the flap piece is not provided below the jaw of the container, a space can be provided between the lower portion of a resealing upper closure portion and the outside surface of the mouth portion of the container and the upper surface of the support ring. Thus, at the time of removing the upper closure, a finger can be easily placed on the lower portion of the upper closure, and the openability can be further increased.

Then, by pushing the removed resealing upper closure into the mouth portion of the container, the resealing operation can be carried out using a comparatively small force.

In the plastic tear-off type cap of this invention, it is preferred that the above-mentioned flap pieces should be provided via a continuous base portion having a small width which projects diametrically inwardly from the inner surface of the skirt. By providing the root of the flap piece at the continuous base portion, the upward bending of the flap piece becomes free and easy, and especially, it becomes possible to position the flap piece along the lower surface of the engaging jaw of the container. Furthermore, at the time of molding of the cap, the flap piece is bent downwardly, and the cap can be removed easily from the mold by forcible removal. Further, when the molding is carried out in a condition in which the continuous base portion is tilted downwardly, the above mold withdrawal is easier. By reversing the continuous base portion, the flap piece can be motivated so that the flap piece points upwardly.

Preferably, a concave portion for the flap (flap-concave portion) which receives an upwardly bent flap piece is formed in the inner surface of the skirt above the root of the flap piece. At the time of capping, the engaging jaw of the container should climb over the flap piece. In this embodiment, since the flap piece enters the concave portion and is widened diametrically outwardly, the flap piece is not damaged at the time of capping, and the capping operation becomes easy.

Preferably, the flap piece is provided so that its thickness increases from the root toward the tip portion. According to this construction, since the flap piece becomes easily bent from its root and its tip portion becomes thick, the engagement of the engaging jaw becomes accurate.

Preferably, the opening band is provided with a notched portion or a weakened portion which extends perpendicularly or obliquely, and a portion of the opening band adjacent to the notched portion or the weakened portion is provided with an opening-starting tab which projects diametrically outwardly. In accordance with this construction, by holding the opening-starting tab and pulling the tab, when the notched portion is provided, the tear-off portion is directly broken, and when the weakened portion is provided, it is first broken and the tear-off portion is then torn, and the opening band can be removed.

The tear-off portion which defines the resealing upper closure portion and the opening band may be, for example, a peripherally formed groove having a thin thickness. The groove of this structure may be formed at the time of molding a cap. Furthermore, when a bridge and a groove which extend in a perpendicular direction below the engaging protrusion are arranged alternately and cuts are formed peripherally leaving at least a portion of the bridge, the opening band can be removed by the breakage of the bridges and an advantage can be obtained in that the opening force may be controlled easily.

When after the molding of the cap, cuts are formed from an outer surface of the skirt to form a tear-off portion, it is preferred from the stability of molding that the bridge provided in the inner surface of the skirt is left and peripheral cuts are formed rather than a peripheral thin portion is left.

EXAMPLE

Figure 1:
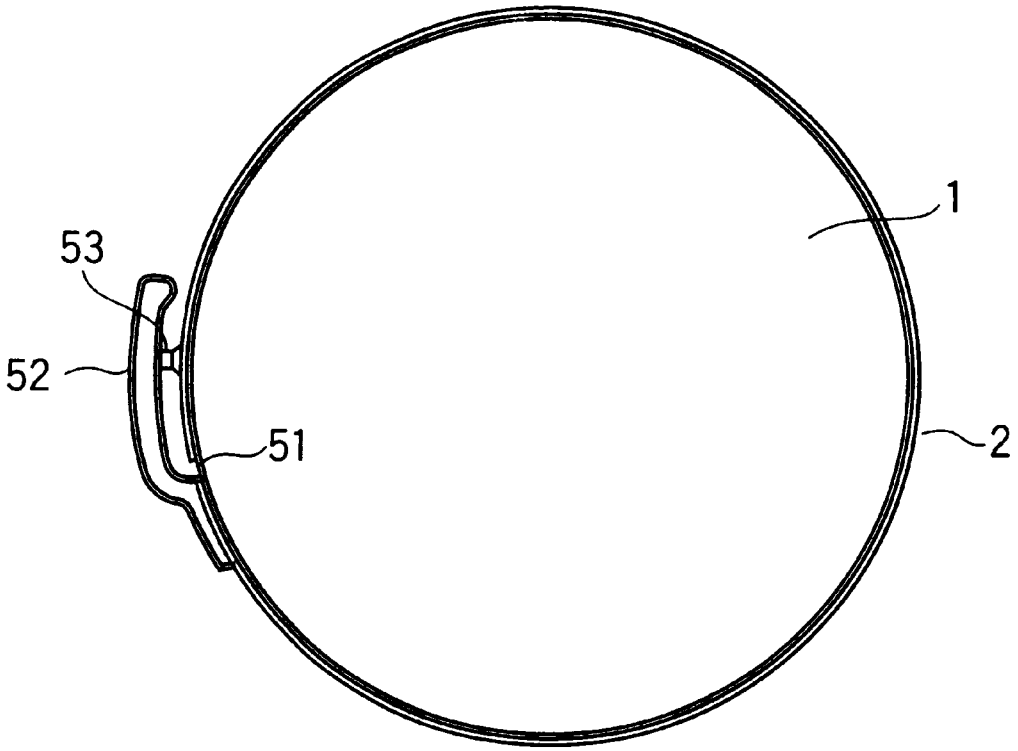
FIG. 1 shows a top view of one example of the cap of this invention.

The present invention will be described by the following Examples.

The plastic cap of this invention, roughly speaking, is composed of a top plate 1 provided with a sealing portion to be engaged with the mouth of a bottle, a skirt 2 extending downwardly from the top plate 1 and a tear-off portion 3 arranged around the skirt 2. The skirt 2 is divided into an upper closure portion 4 for resealing and a lower opening band 5 due to the tear-off portion 3.

Figure 7:
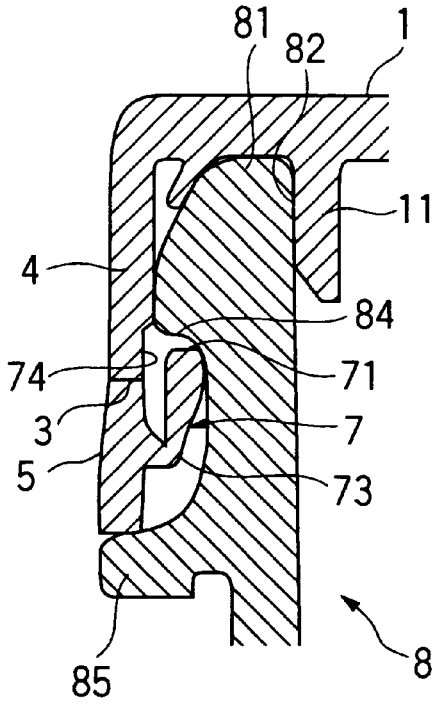
FIG. 7 is an expanded partial sectional view showing an engaged condition of a flap piece and an engaging jaw of the container during sealing.
Figure 8:
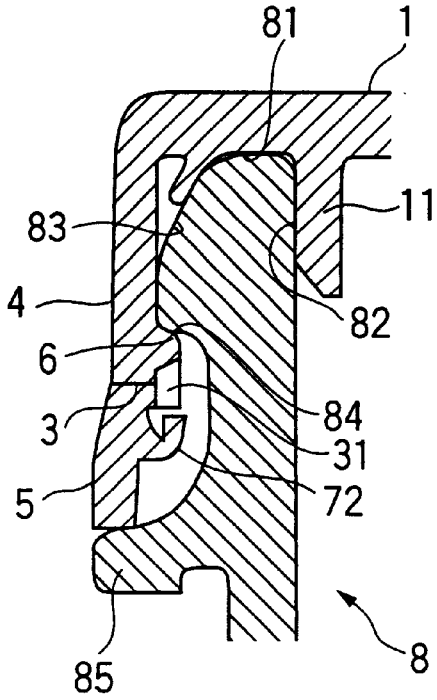
FIG. 8 is an expanded partial sectional view showing an engaged condition of an engaging protrusion and an engaging jaw of the container during sealing.
Figure 9:
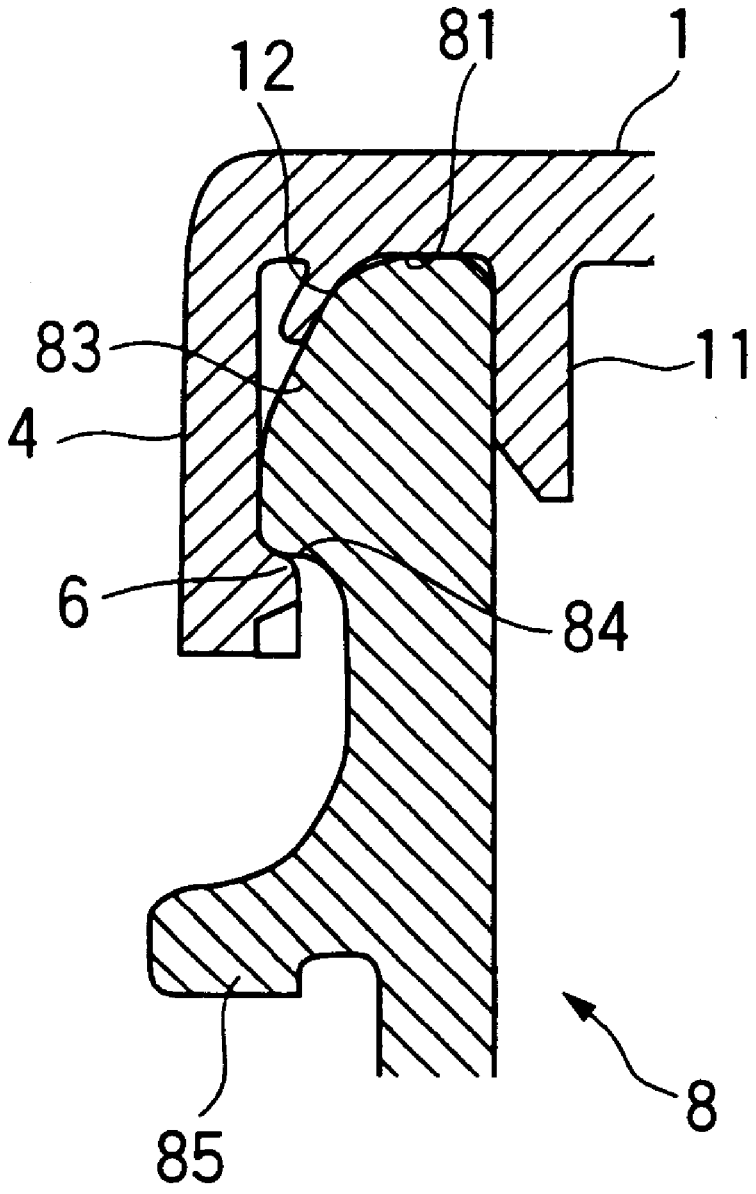
FIG. 9 is an expanded partial sectional view showing an engaged condition of an engaging protrusion and an engaging jaw of the container at the time of removing the opening band or at the time of resealing.

The neck 8 of the bottle for mounting the cap of this invention, as shown in FIGS. 7 to 9, is provided with a top plane 81 of the mouth portion, an inner surface 82 of the mouth portion, an outer peripheral surface 83 of the mouth portion, a jaw 84 for engaging the cap, and a support ring 85 which concurrently protects the opening band.

Figure 6:
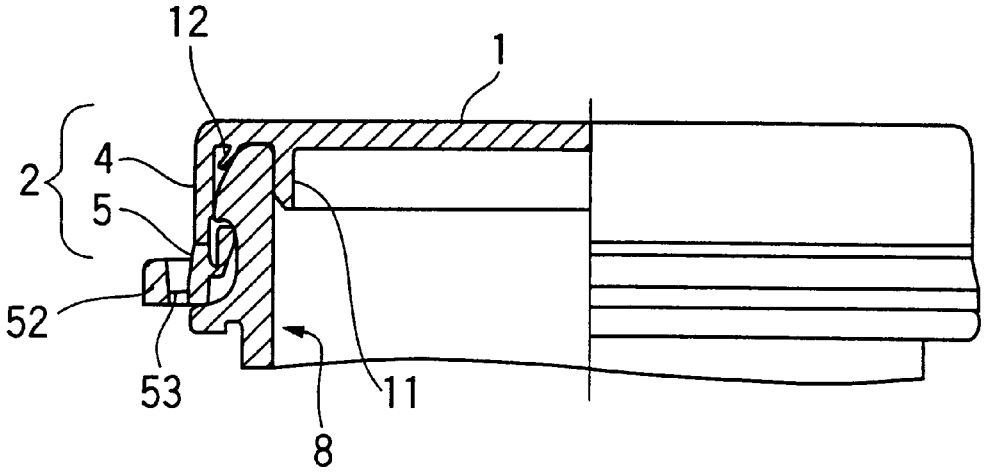
FIG. 6 is a side view, partly shown in section, representing a condition in which the cap of FIG. 1 is capped to the container.

The seal portion provided on the inner surface of the top plate 1 may be any known sealing mechanism. In this specific example, it is composed of an inner ring 11 engaged with the inner surface 82 of the mouth portion and an outer ring 12 engaged with the outer peripheral surface 83 of the mouth portion, and at the time of capping, these rings are engaged with the mouth of the bottle to accomplish sealing (see FIG. 6). The inner ring 11 extends in an inclined manner so that its diameter gradually increases from the top plate 1 in a downward direction. A compression force can be added diametrically outwardly to the mouth portion of the bottle. The outer ring 12 extends downwardly and outwardly so that it can add a compression force downwardly and diametrically inwardly toward the mouth portion of the bottle. The inner ring 11 acts together with the outer ring 12 or the engaging protrusion 6 and the flap piece 7 which are described latter to form a reliable sealing with the mouth portion of the bottle.

At an upper position beyond the tear-off portion 3 in the inner surface of the skirt 2, the diametrically inwardly-directed engaging protrusion 6 engaged with the jaw 84 of the bottle was formed peripherally and intermittently, and at a lower position than the tear-off portion 3 (that is, in the inner surface of the opening band 5), the flap piece 7 in which the tip portion 71 in a sealed condition is engaged with the jaw 84 of the bottle is provided peripherally and intermittently. Furthermore, as is well shown in FIGS. 2, 3, 4 and 5, the engaging protrusions 6 and the flap pieces 7 are positioned alternately in most of the peripheral direction.

Figure 2:
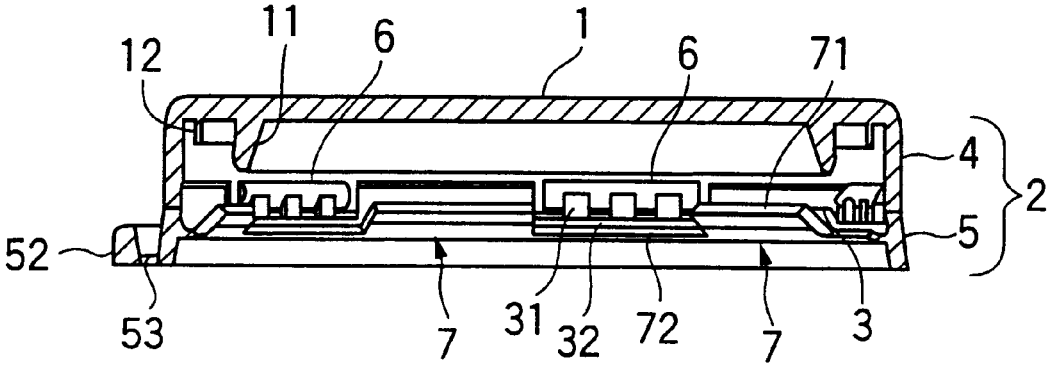
FIG. 2 is a side sectional view of the cap of FIG. 1.
Figure 3:
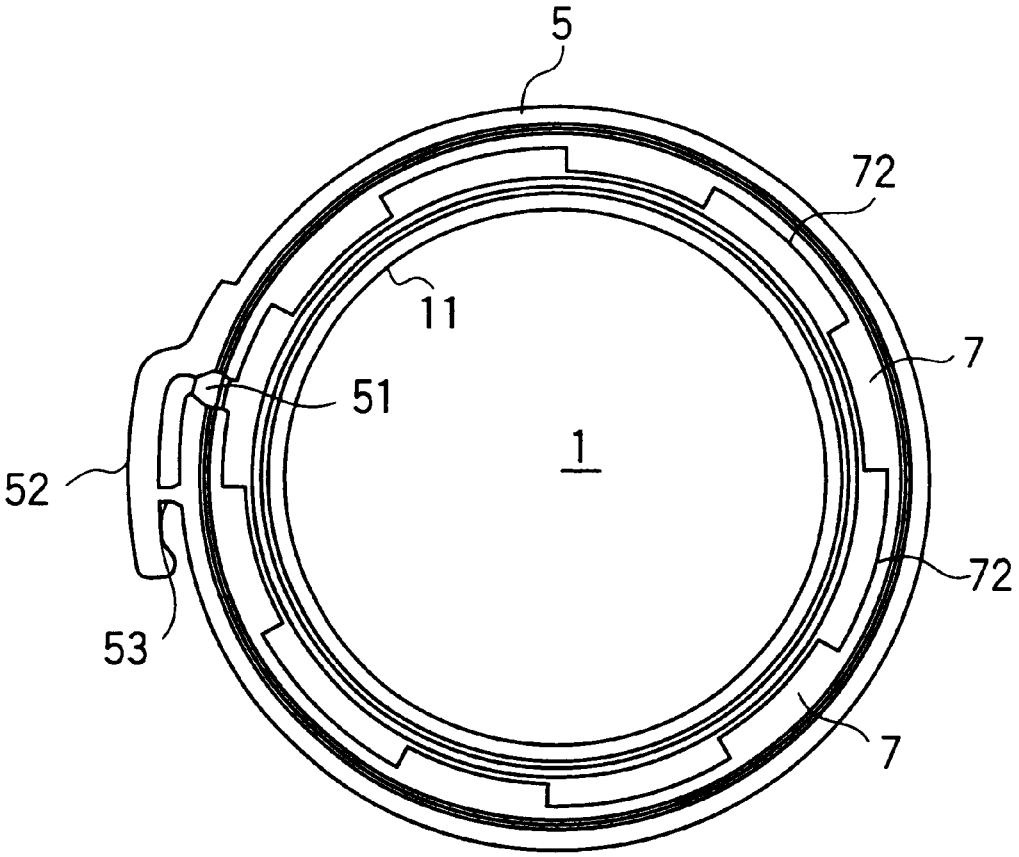
FIG. 3 is a bottom view of the cap of FIG. 1.
Figure 4:
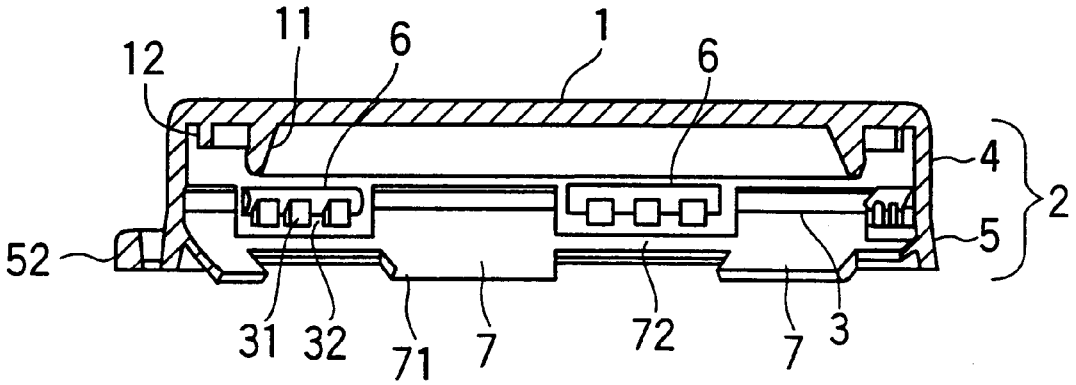
FIG. 4 is a side sectional view of a condition before rising and reversing flap pieces and continuous base portions of the cap of FIG. 2.
Figure 5:
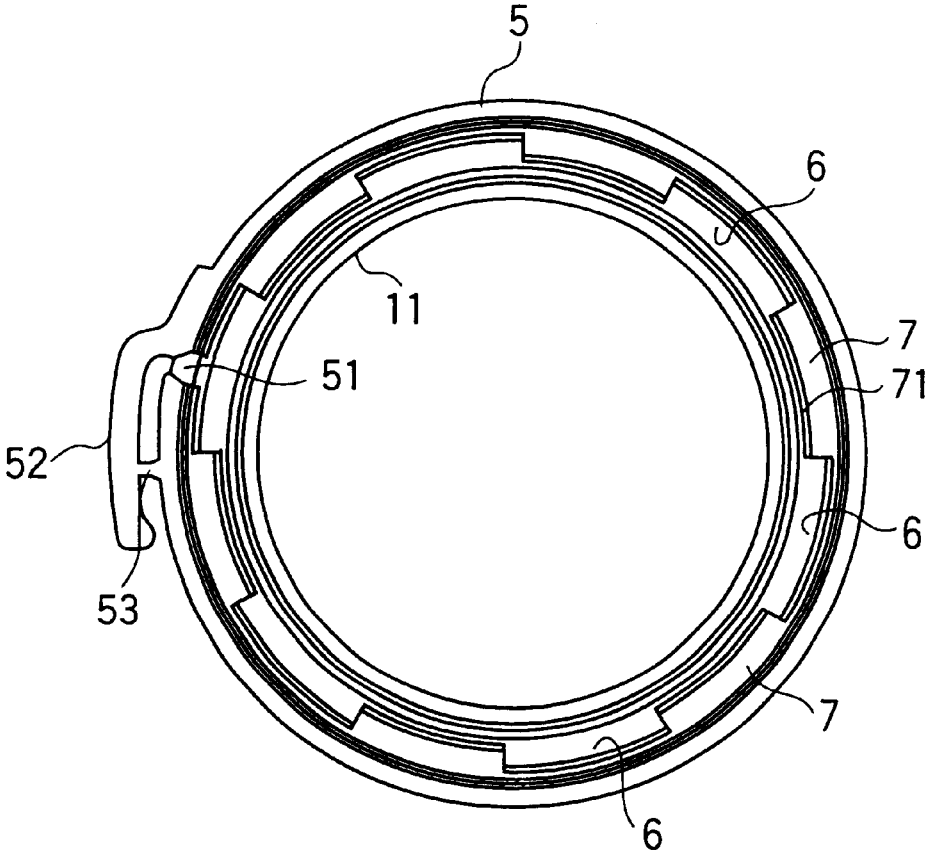
FIG. 5 is a bottom view of a condition before rising and reversing flap pieces and a continuous base portion of the cap of FIG. 3.

In this specific example, the flap pieces 7, as well shown in FIGS. 2, 3, 4 and 5, are provided via a continuous base portion 72 having a small width projecting diametrically inwardly from the inner surface of the skirt. By providing the flap pieces 7 integrally with the continuous base portion 72, the upward bending of the flap pieces 7 becomes free and easy. In particular, it becomes possible to position the flap pieces 7 along the lower surface of the engaging jaw 84 of the bottle. FIGS. 4 and 5 show a condition in which the flap pieces 7 and the continuous base portion 72 are as molded, namely a condition before reversing, but in the molding of the cap, the flap pieces 7 can be bent downwardly, and it is easy to withdraw the flap pieces 7 from the mold by forcible removal. Furthermore, FIGS. 2 and 3 show a condition in which the flap pieces 7 and the continuous base portion 72 are reversed upwardly. The upward reversing of the continuous base portion 72 is motivated to direct the flap pieces 7 upwardly. The upward reversing of the flap pieces 7 and the continuous base portion 72 can be carried out by engaging the flap pieces 7 and the continuous base portion 72, which are as molded, with processing molds.

As is well shown in FIG. 7, the flap pieces 7 are provided so that its thickness from the root 73 (the continuous base portion) toward the tip portion 71 increases. According to this construction, the flap pieces 7 become easy to bend from the root 73. Since the tip portion 71 becomes thick, its engagement with the engaging jaw 84 becomes accurate.

In the inner surface of the skirt 2 above the root 73, a flap-concave portion 74 which receives an upwardly bent flap piece 7 is formed. At the time of capping, the engaging jaw 84 of the bottle should climb over the flap piece 7. Since according to the above construction, the flap piece 7 is widened diametrically outwardly by coming into the concave portion 74, the flap piece 7 is not damaged at the time of capping, and the capping operation is carried out easily with a comparatively small capping pressure.

In accordance with the above Example, since the flap piece 7 is used as an engaging portion for holding tamper-evidence and, the flap piece 7 is bent upwardly at the time of capping, the mouth of the bottle is easily inserted into the cap. The engaging position due to the tip portion 71 of the flap piece, as shown in FIG. 7, can be set at a position above the opening band 5.

As shown in FIGS. 3 and 5, the engaging protrusion 6 and the flap piece 7 can be positioned alternately in most of the peripheral direction, namely the bent flap piece 7 can be positioned in an omitted portion of the engaging protrusion 6. Thus, accordingly, the single engaging jaw 84 of the bottle can be utilized simultaneously to engage the upper closure portion 4 for resealing and to engage the opening band 5.

From after capping up to opening, the resealing upper closure portion 4 and the opening band 5 are in an integrated state and both the engaging protrusion 6 and the tip portion 71 of the flap piece 7 are engaged with the engaging jaw 84. Accordingly, the upward or the diametrically inward pressure for sealing can be increased, and sealability having high reliability can be performed. Furthermore, since the flap pieces 7 are intermittently arranged, the upward bending of the flap pieces 7 is performed easily, and the capping operation is easy.

When the opening band 5 is removed, the flap pieces can be removed simultaneously, and as shown in FIG. 9, since the resealing upper closure portion 4 is engaged with the engaging jaw 84 at only the engaging protrusion 6 arranged intermittently. The force required to open the upper closure portion 4 is weakened, and the opening can be carried out easily by using a finger. The same can be said with respect to the resealing of the upper closure portion 4.

The tear-off portion 3 defining the resealing upper closure portion 4 and the opening band 5 is not particularly limited. In this Example, as shown in FIGS. 2 and 4, bridges 31 and grooves 32 extending in a perpendicular direction below the engaging protrusion 6 are arranged alternately to form a peripheral cut leaving at least a portion of the bridge 31. The band 5 can be removed by breaking the bridges 31. Hence, the opening force can be controlled easily.

In the cap of this invention, as shown in FIGS. 1 and 3, the opening band 5 is provided with a notched portion or weakened portion 51 which extends perpendicularly or obliquely, and a portion of the opening band adjacent to the notched portion or weakened portion 51 is provided with a diametrically outwardly projecting opening-starting tab 52. In this construction, by holding the opening-starting tab 52 and pulling it, when 51 is the notched portion, the tear-off portion 3 is directly broken, and when 51 is the weakened portion, it is first broken and then tearing is carried out at the tear-off portion. Thus, the opening band 5 can be removed.

The illustrated opening-starting tab 52 is composed of a peripherally extending band-like body which is easy to hold by a finger. To restrict its free movement, the band 5 and the tab 52 are connected by means of a breakable bridge 53.

In this cap, the number and size of the engaging protrusions 6 and the flap pieces 7 differ according to the size and the material of the cap. The number of the engaging protrusions 6 and the flap pieces 7 is generally 3 to 15, especially 5 to 10, per circuit.

Furthermore, the size (L1) of one engaging protrusion 6 in a peripheral direction ranges from 4 to 16 mm, especially from 6 to 10 mm. The size (L2) of one flap piece 7 in a peripheral direction ranges from 4 to 16 mm, especially from 6 to 10 mm. The ratio of both (L1/L2) preferably ranges from 0.5 to 2.0, especially from 0.8 to 1.5.

The engaging size t in a diametrical direction between the engaging protrusion 6 and the engaging jaw 84 is within a fixed preferred range. Generally, t preferably ranges from 0.2 to 1.5 mm, especially from 0.5 to 1.0 mm. The intermittently arranged structure of the engaging protrusion 6 of this invention can offer an advantage that the opening of the upper closure portion 4 is easy even when the engaging size t is comparatively large.

Resins used for molding the cap include various plastics, for example, low-, medium- or high-density polyethylenes, linear low-density polyethylene, polypropylene, thermoplastic polyesters, polyamides, styrene resins and ABS resins.

The plastic caps of this invention are usually produced in a condition in which the resealing upper closure portion and the opening band are integrated by using the above resins in accordance with injection molding, compression molding, etc. The tear-off portion plate, and a tear-off portion arranged around the skirt and defining an upper closure portion for resealing and a lower opening band, wherein in the inner surface of the skirt, at an upper position of the tear-off portion, a diametrically inwardly-directed protrusion which is engaged with a jaw of the container is formed peripherally intermittently, simultaneously, at a lower position than the tear-off portion, a flap piece whose tip portion is engaged with the jaw of the container is formed peripherally intermittently, and the engaging protrusion and the flap piece are formed at least alternately in most of the peripheral direction. Advantages are obtained in that by the above construction, one-stage engaging jaw placed at the neck of the container offers tamper-evident property and resealing property, the cap height is lowered, the resin weight of the cap is decreased, and excellent sealing reliability, easy openability and tamper-evident property can be maintained.

Especially, in the cap of this invention, since the engaging protrusion are arranged intermittently, the opening of the cap is easy, but until the opening band is removed, the cap can be effectively held by cooperation of the flap pieces.

What is claimed:

1. A plastic cap being fitted with a mouth of a container by pushing, said plastic cap comprising a top plate provided with a sealing portion to be engaged with the mouth of the container, a skirt extending perpendicularly from the top plate, and a tear-off portion arranged around the skirt and defining an upper closure portion for resealing and a lower opening band, wherein in an inner surface of the skirt, at a position which is axially higher than the tear-off portion, a diametrically inwardly-directed protrusion which is engaged with a jaw of the container is formed peripherally intermittently, at a position which is axially lower than the tear-off portion, a flap piece whose tip portion is engaged with the jaw of the container is formed peripherally intermittently, via a continuous base portion having a small width and projecting diametrically inwardly from the inner surface of the skirt, the flap piece being provided so that its thickness increases from the root of the flap piece to its tip portion, and the flap piece and the protrusion are formed at least alternately in most of the peripheral direction;

a flap-concave portion receiving the flap piece which is bent upwardly, is formed in the inner surface of the skirt above a root of the flap piece;

a notched portion or a weakened portion, which extends perpendicularly or obliquely and reaches the tear-off portion, is formed in the opening band; and on an outer surface of the opening band, an opening-starting tab for tearing peripherally the tear-off portion which projects diametrically and outwardly, is provided at a portion adjacent to the notched portion or the weakened portion, whereby said opening band is broken before said upper closure portion.

2. A cap of claim 1 wherein perpendicularly extending bridges are arranged at intervals in a lower portion of the protrusion, and a cut is formed peripherally so that the bridges are left, whereby the tear-off portion is composed of the bridges and the cut.

3. A cap of claim 1 wherein the tear-off portion is composed of a peripheral groove.

* * * * *